US005111587A

United States Patent [19]

Plank

[11] Patent Number: 5,111,587

[45] Date of Patent: May 12, 1992

[54] ADAPTOR FOR RELEASABLY ATTACHING A SIGHTING TELESCOPE TO A WEAPON

[75] Inventor: Franz Plank, Munich, Fed. Rep. of Germany

[73] Assignee: Carl-Zeiss-Stiftung, Heidenheim, Fed. Rep. of Germany

[21] Appl. No.: 706,878

[22] Filed: May 29, 1991

[30] Foreign Application Priority Data

May 30, 1990 [DE] Fed. Rep. of Germany ... 9006133[U]

[51] Int. Cl.[5] ..... F41G 1/38

[52] U.S. Cl. ..... 33/247; 33/252; 33/233; 42/101

[58] Field of Search ..... 33/250, 249, 247, 252, 33/233; 42/100, 101

[56] References Cited

U.S. PATENT DOCUMENTS

| | | | |
|---|---|---|---|
| 1,837,290 | 12/1928 | Redfield . | |
| 2,942,346 | 6/1960 | Staubach | 33/250 |
| 3,153,856 | 10/1964 | Felix | 33/250 |
| 4,021,954 | 5/1977 | Crawford | 33/250 |
| 4,027,414 | 6/1977 | Felix | 33/250 |
| 4,085,511 | 4/1978 | Kovac | 33/250 |
| 4,249,315 | 2/1981 | Hopson, III | 33/250 |
| 4,341,022 | 7/1982 | Santoro | 33/250 |
| 4,776,126 | 10/1988 | Williams | 33/247 |
| 4,845,871 | 7/1989 | Swan | 33/250 |
| 4,959,908 | 10/1990 | Weyrauch | 33/245 |

FOREIGN PATENT DOCUMENTS

| | | | |
|---|---|---|---|
| 0103510 | 3/1984 | European Pat. Off. | 33/250 |
| 0723468 | 8/1942 | Fed. Rep. of Germany | 42/101 |
| 2240844 | 2/1974 | Fed. Rep. of Germany . | |
| 972621 | 10/1964 | United Kingdom . | |
| 1012820 | 12/1964 | United Kingdom | 42/101 |

*Primary Examiner*—William A. Cuchlinski, Jr.
*Assistant Examiner*—William C. Dowling
*Attorney, Agent, or Firm*—Walter Ottesen

[57] ABSTRACT

The invention is directed to an adaptor for releasably attaching a sighting telescope to a weapon. The adaptor includes an elongated base body having upper and lower sides with a holder formed on the upper side for holding the sighting telescope therein. A rigid fixing element is formed on the lower surface of the base body for engaging the weapon at a first location thereon and a movable fixing element releasably engages the weapon at a second location thereon. The adaptor affords the advantage that a tedious alignment of both fixing elements with respect to each other is eliminated when mounting the adaptor on the weapon. A later misalignment of the two fixing elements to each other is no longer possible since they are both disposed on one and the same base body.

19 Claims, 4 Drawing Sheets

3
5
6a
6b
7
8
9
11
11a
13
18
19
20
21
22
23
24
25
26
27
3a
3,8
a
b
c

ADAPTOR FOR RELEASABLY ATTACHING A SIGHTING TELESCOPE TO A WEAPON

FIELD OF THE INVENTION

The invention relates to an adaptor for releasably attaching a sighting telescope to a weapon at two fixing locations with rigid and movable fixing elements, respectively.

BACKGROUND OF THE INVENTION

Such adaptors are available in very different configurations and comprise two discrete parts. The part mounted at the forward region of the sighting telescope generally includes a clamp on which a pivot lug is disposed. A further discrete part of the adaptor is attached to a region of the sighting telescope which lies farther toward the rear. This part generally has a movable fixing element for releasably assembling the sighting telescope on the weapon.

It is a disadvantage that a clamp applies a significant force to the forward part of the sighting telescope thereby inducing stresses in the forward lenses of the sighting telescope when the assembly is conducted in an unskilled manner. Furthermore, the attachment of both parts of the adaptor must take place so as to be matched to each other as well as being matched to the weapon. This causes a difficult alignment during assembly with alignment errors occurring because of a skewed position of the optical axis of the sighting telescope with respect to the bore axis of the barrel of the weapon.

U.S. Pat. No. 4,959,908 discloses an attachment arrangement for attaching a sighting telescope to an intermediate piece with the sighting telescope being attached with a rail to an intermediate piece having a wedge-shaped cross section. This patent makes no disclosure with respect to the attachment of the intermediate piece to the weapon and the specific configuration of the intermediate piece.

SUMMARY OF THE INVENTION

It is an object of the invention to provide an adaptor which permits a simple and reliable assembly of the sighting telescope on a weapon.

The adaptor of the invention is for releasably attaching a sighting telescope to a weapon. The adaptor includes: an elongated base body having upper and lower sides; holding means formed on the upper side for holding the sighting telescope therein; rigid fixing means formed on the lower surface for engaging the weapon at a first location on the weapon; and, movable fixing means for releasably engaging the weapon at a second location on the weapon.

The invention affords the advantage that the tedious alignment of both fixing elements with respect to each other is eliminated when assembling the adaptor to a weapon. A later misalignment of the two fixing elements to each other is no longer possible because they are both disposed on one and the same base body.

This new configuration of the adaptor permits the base body to be so configured that it provides a supporting surface over its entire length for the sighting telescope.

The adaptor includes an elongated rail guide having a V-shaped or wedge-shaped cross section on the upper side of the adaptor. For this reason, an automatic alignment of the sighting telescope to the adaptor is provided for sighting telescopes having a V-shaped or wedge-shaped rail.

The movable fixing element having a stop and a movable clamping piece affords the advantage that the adaptor can be moved until the stop engages the weapon during assembly thereon and then, in the predetermined position, the clamping piece provides a final fixing between adaptor and weapon.

With the movement of the clamping piece by means of a slide, a convenient manipulation during assembly as well as during disassembly is obtained because the slide can be grasped from both sides.

The slide is provided with a fixing element for fixing the position of the mounted adaptor. In this way, an additional guarantee is provided against an unintended change in position of the slide.

A return element in the interior of the adaptor provides for a defined position of the clamping piece when the slide is pulled back.

The rotatable journalling of the movable clamping piece is more reliable to operate than a displaceable journalling.

The pivot axis of the movable clamping piece is parallel to an axis extending between the two fixing elements. For this reason, the clamping piece does not move out of its fixed position when a shot is fired from the weapon.

By configuring the interface line between the clamping piece and the sighting telescope so as to be closed at least laterally, the danger of dirt is reduced and cleaning is facilitated. In this way, it is not necessary to disassemble the sighting telescope from the adaptor for the purposes of cleaning.

The advantages of the applicant's adaptor can be advantageously combined with the releasable attachment described in U.S. Pat. No. 4,959,908.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
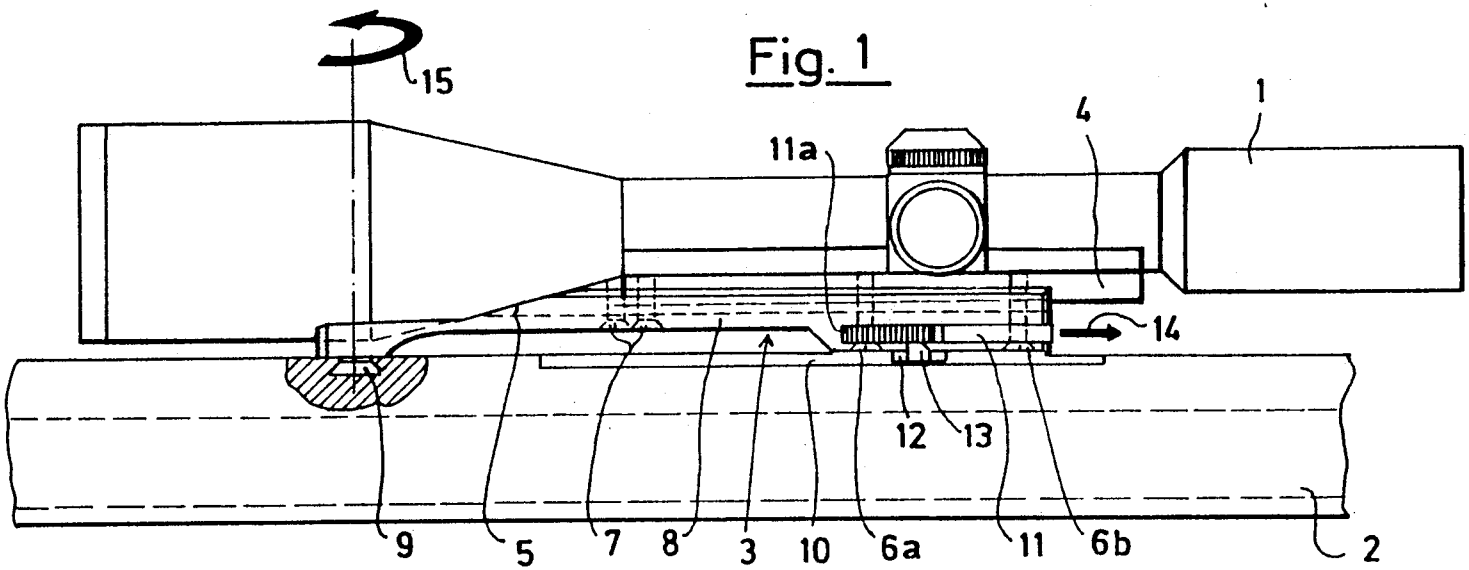
FIG. 1 is a side elevation view of a telescope mounted on a weapon by means of the adaptor according to the invention.

FIG. 1 shows a sighting telescope 1 mounted on a weapon 2. An adaptor 3 is disposed between the sighting telescope 1 and the weapon 2 and includes a single base body 8.

The sighting telescope 1 has a trapezoidally-shaped rail 4 on the side thereof facing toward the weapon 2. This rail 4 acts to fix the sighting telescope 1 to the adaptor 3. The rail 4 has a V-shaped or wedge-shaped cross section and lies in a V-shaped or wedge-shaped rail guide 5 of the adaptor 3 (see also FIGS. 7*b* and 8*b*). The rail guide 5 has an opening angle which is matched to the tapered angle of the rail 4. In this way, the sighting telescope 1 is automatically aligned relative to the adaptor 3 when the rail 4 is inserted into the rail guide 5 of the adaptor 3.

The precise constructive features and the advantages of a sighting telescope having a trapezoidally-shaped rail are disclosed in U.S. Pat. No. 4,959,908 incorporated herein by reference. The connection of the sighting telescope 1 to the adaptor 3 is as described in this patent.

The sighting telescope 1 lies in contact engagement on the entire length of the adaptor 3. Four threaded fasteners (7, 6*a*, 6*b*) provide an excellent connection of the sighting telescope 1 to the adaptor 3.

The adaptor 3 is fixed to the sighting rail of the weapon 2 at two locations. The forward fixing takes place by means of a fixing element 9 connected rigidly to the adaptor 3. This rigid fixing element 9 is configured as a pivot pin which is disposed in a correspondingly formed pivot pin hole 16 (see FIG. 2).

Figure 7B:
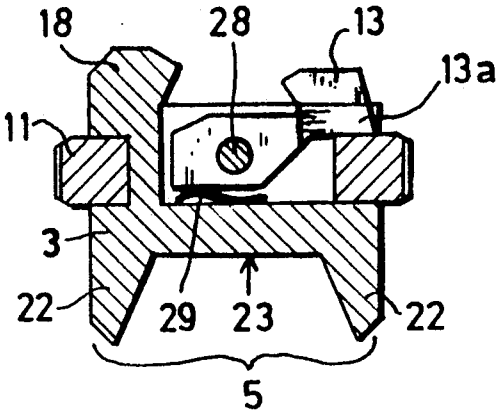
FIG. 7*b* is a section view taken along line VII*b*–VII*b* of FIG. 7*a;*
Figure 8B:
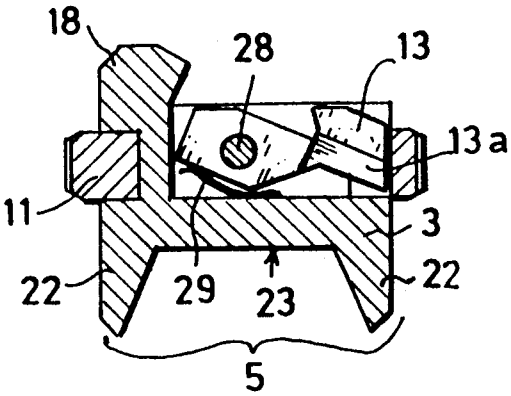
FIG. 8*b* is a section view taken along line VIII*b*–VIII*b* of FIG. 8*a;* and, FIG. 9 is a detail view of a slide having a position detent device.

The rearward fixing takes place at a plane-parallel holding plate 10 on the sighting rail of the weapon 2. Prismatic holding notches 12 are provided on this plate 10 at both sides thereof, respectively. A fixing wedge or clamping piece 13 engages in the holding notch 12 visible in FIG. 1. The wedge shape of the fixing wedge 13 is shown in FIGS. 7*b* and 8*b*. On the side not visible in FIG. 1, a wedge-shaped stop 18 engages in the second holding notch 12 which is likewise not visible in FIG. 1. The wedge shape of the stop 18 is shown in FIGS. 7*b* and 8*b*.

A slide 11 is also shown in FIG. 1 by means of which the fixing wedge 13 can be moved. In the position of the slide 11 shown in FIG. 1, the sighting telescope 1 is firmly attached to the weapon 2 by the adaptor 3.

Figure 2:
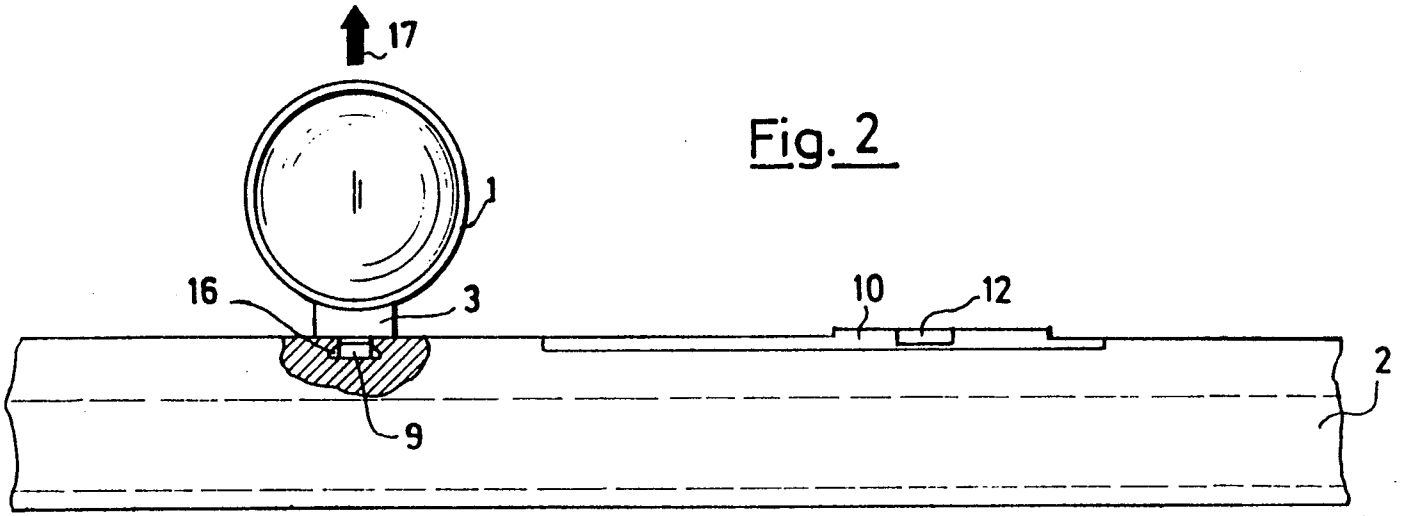
FIG. 2 is a side elevation view showing the removal of the sighting telescope from the adaptor.

For disassembling the adaptor 3 and the sighting telescope 1 attached to the adaptor, the slide 11 must be pushed rearwardly in the direction shown by arrow 14 (see FIGS. 1 and 2). In this way, the fixing wedge or clamping piece 13 disappears in the interior of the adaptor 3. How this happens will be explained later with respect to FIG. 7*a*, FIG. 7*b*, FIG. 8*a* and FIG. 8*b*.

By rotating the sighting telescope with the adaptor 3 in the direction of arrow 15, the stop 18 is also moved out of the holding notch 12 corresponding thereto. When the sighting telescope is approximately at right angles to the weapon 2, the telescope can be lifted in the direction of arrow 17 and the telescope together with the adaptor 3 is separated completely from the weapon 2.

The significant advantage of this type of attachment is seen in that the sighting telescope 1 is easily mounted on and removed from the weapon 2 with a precise alignment of the sighting telescope 1 relative to the weapon 2 being made certain for each assembly.

A large supporting surface of the sighting telescope 1 on the adaptor 3 is obtained by the homogeneous one-piece configuration of the adaptor 3. Furthermore, no lateral intermediate space is present between the sighting telescope 1 and the adaptor 3 in which other bodies can become caught and thereby apply an impermissible force to the sighting telescope 1.

The intermediate space between adaptor 3 and weapon 2 can be freely configured with an advantage being provided when this intermediate space is made as small as possible so that the spacing between the sighting line and the bore axis is not too great.

Figures 3, 4, 5, 6:
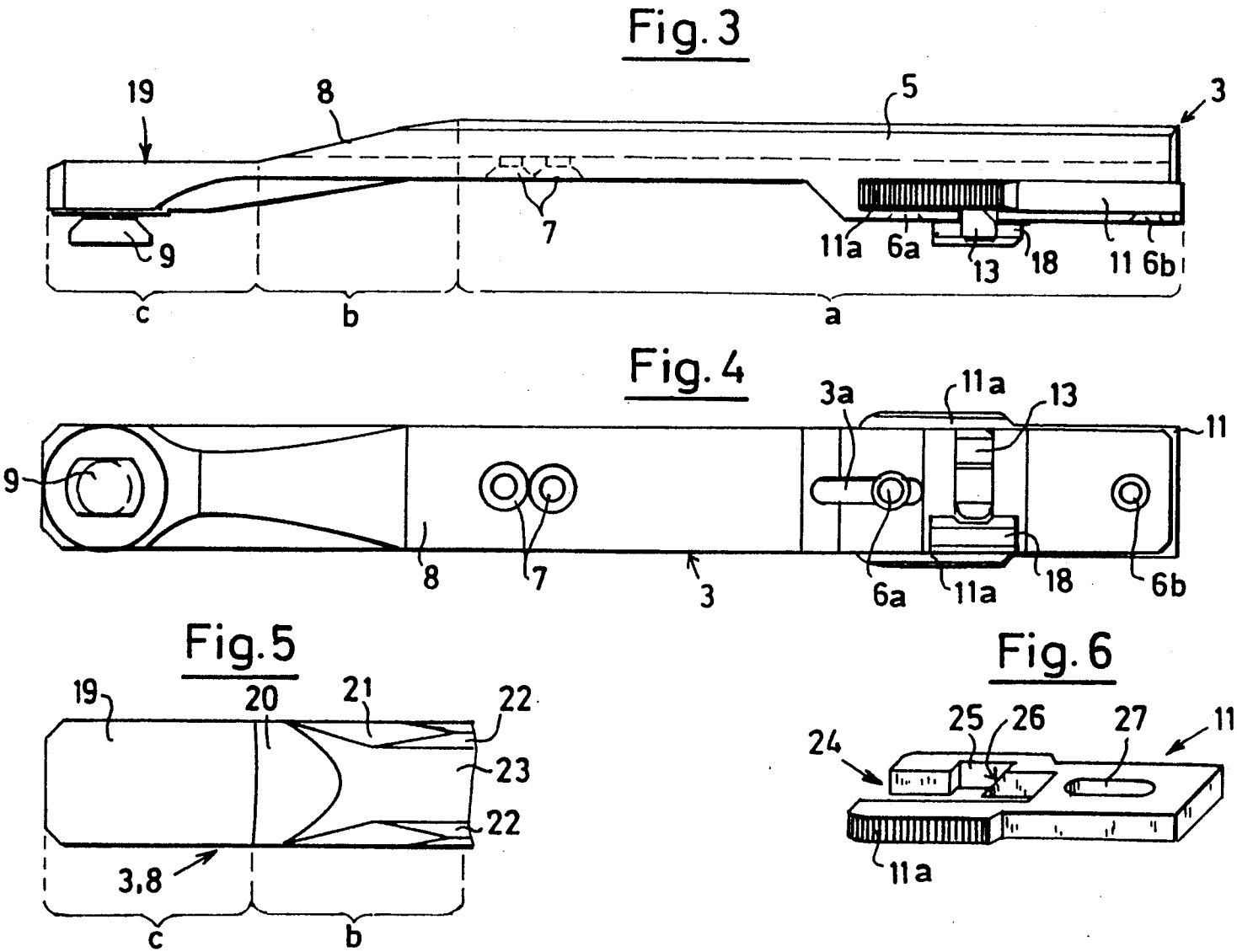
FIG. 3 is a side elevation view of the adaptor according to the invention.
FIG. 4 is a plan bottom view of the adaptor of FIG. 3.
FIG. 5 is a detail plan view of the forward region of the adaptor.
FIG. 6 is a detail view of the slide.

The adaptor 3 is shown enlarged in FIGS. 3 and 4 with FIG. 3 being a side elevation view and FIG. 4 being a view from below.

The base body 8 is comprised essentially of an elongated massive steel body. In the rearward region (a), the base body has a wedge-shaped rail guide 5 having a flat base wall 23 in the region thereof facing toward the sighting telescope as shown in FIGS. 7*b* and 8*b*. By constructing the side walls 22 as extending to a tip, a clean edge is obtained as an interface line between the adaptor 3 and the rail 4 of the sighting telescope 1. In the forward and rearward portions, the wedge-like lateral guide terminates in respective openings.

The following region (b) is an adaptation region which extends into region (c). In region (c), the surface 19 of the base body 8 facing toward the sighting telescope is slightly arcuate with the radius of the curved surface corresponding to the radius of the housing of the sighting telescope 1.

The base face 20 and the side faces 21 of the region (b) (see also FIG. 5) are adapted in their shape to the housing of the sighting telescope 1 so that the sighting telescope lies upon the base body 8 in the regions (a) to (c).

In the lower portion of the base body 8, the base body 8 has a lug in region (c) in the form of a rigid fixing element 9. The lug in the form of the fixing element 9 is orientated parallel to the longitudinal axis of the adaptor 3. The threaded bores (7, 6*a*, 6*b*) for fastening the clamping parts (not shown) are all disposed in the region (a) of the base body 8. In this connection, reference can be made to U.S. Pat. No. 4,959,908.

The base body 8 becomes thicker in the rearward portion of region (a). The movable fixing element is disposed in this region (a) and is described in detail with reference to FIGS. 7*a*, 7*b*, 8*a* and 8*b*.

The base body 8 has a cutout 3*a* in the rearward portion of region (a) so that the pivot pin 28 (see FIGS. 7*b*, 8*b*) for a fixing wedge in the form of clamping piece 13 can be introduced into the base body 8. The base body 8 has a stop 18 on the side of the rearward portion of the region (a) which faces toward the weapon 3. The stop 18 is so formed that it grippingly engages a holder notch 12 on plate 10 when mounting the adaptor 3 on the weapon 2. For this purpose, the stop 18 has a slight wedge-shaped form parallel to the longitudinal direction of the adaptor 3 (see also FIGS. 7*b* and 8*b*).

In the rearward portion of the region (a), the base body 8 has an elongated opening in which the slide 11 is disposed. This slide 11 is shown in FIG. 6 and displaces the movable fixing wedge 13. Knurls 11*a* are provided on both sides of the slide 11 to facilitate the manipulation thereof. The forward end of the slide 11 includes an opening 24 in the region of the knurl 11*a*. With this opening 24 forward, the slide 11 is pushed into the base body 8 when mounting the adaptor 3. The opening 24 includes a recess 25 on one side thereof. A side 26 of the recess 25 is formed as a wedge face while all other sides in the opening 24 are vertical. An elongated slot 27 is provided in the rearward portion of the slide 11 and is disposed so as to extend in the longitudinal direction of the slide. The precise function of the slide will be explained with respect to FIGS. 7*a*, 7*b*, 8*a* and 8*b*.

Figure 7A:
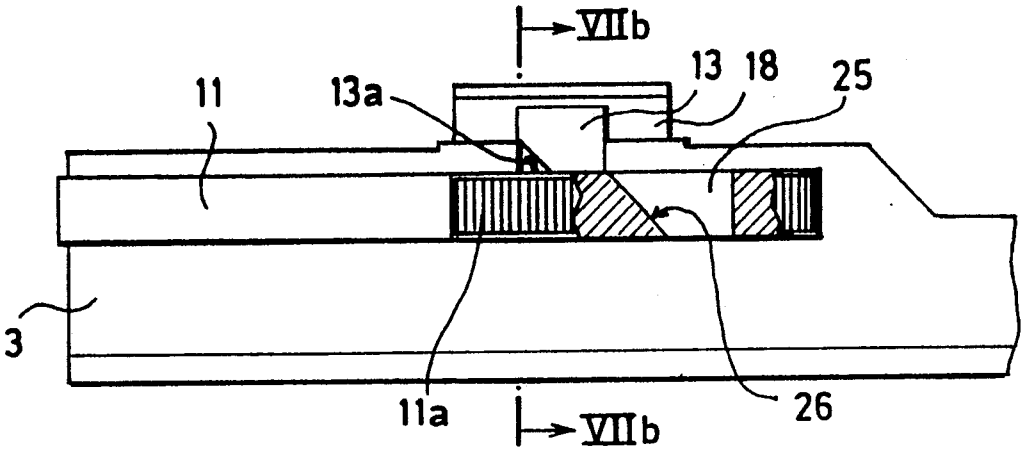
FIG. 7*a* is a side elevation view, partially in section, of the forward part of the adaptor shown in its fixed condition.

The rearward portion of the adaptor 3 is shown in FIGS. 7*a* and 7*b*. The slide 11 is shown in its inserted condition or latch position. The clamping piece 13 is moved into its fixing or clamping position by the wedge face 26 acting on the beveled face 13*a* of the piece 13. Now the clamping piece 13 lies on the slide 11 and is securely held in this position.

The pivot pin 28 is shown in FIG. 7*b* and serves as the pivot pin for the clamping piece 13. The return element 29 is configured as a leaf spring and is in the stressed condition on the side lying opposite to the clamping piece 13 below the pin 28.

Figure 8A:
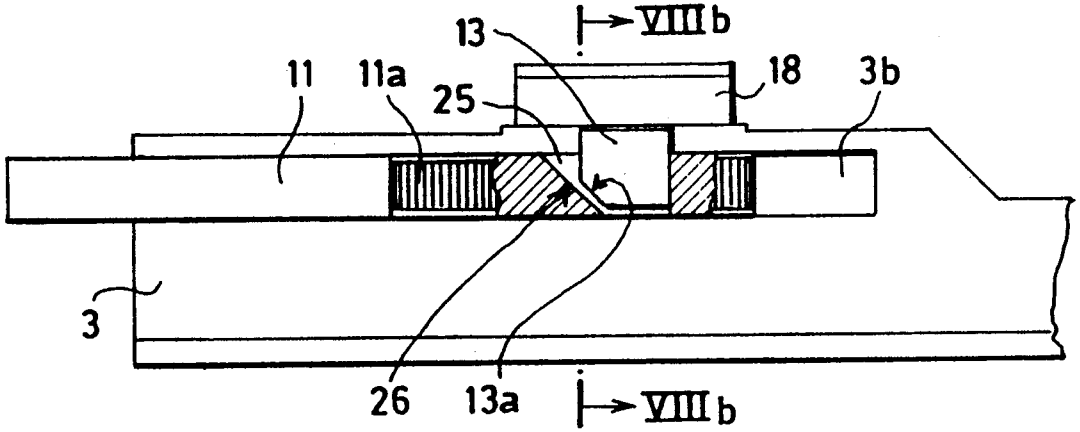
FIG. 8*a* is a side elevation view, partially in section, of the forward part of the adaptor with the slide shown in the pulled back position.

In FIG. 8*a* and 8*b*, the slide 11 is shown in its pulled-out or release position. The return element 29 releases its force and presses the clamping piece 13 into the recess 25 of the slide 11. In this way, the lateral guide slots 3*b* of the base body 8 for the slide 11 become visible which are hidden by the slide 11 when the latter is in its inserted or latch position.

Figure 9:
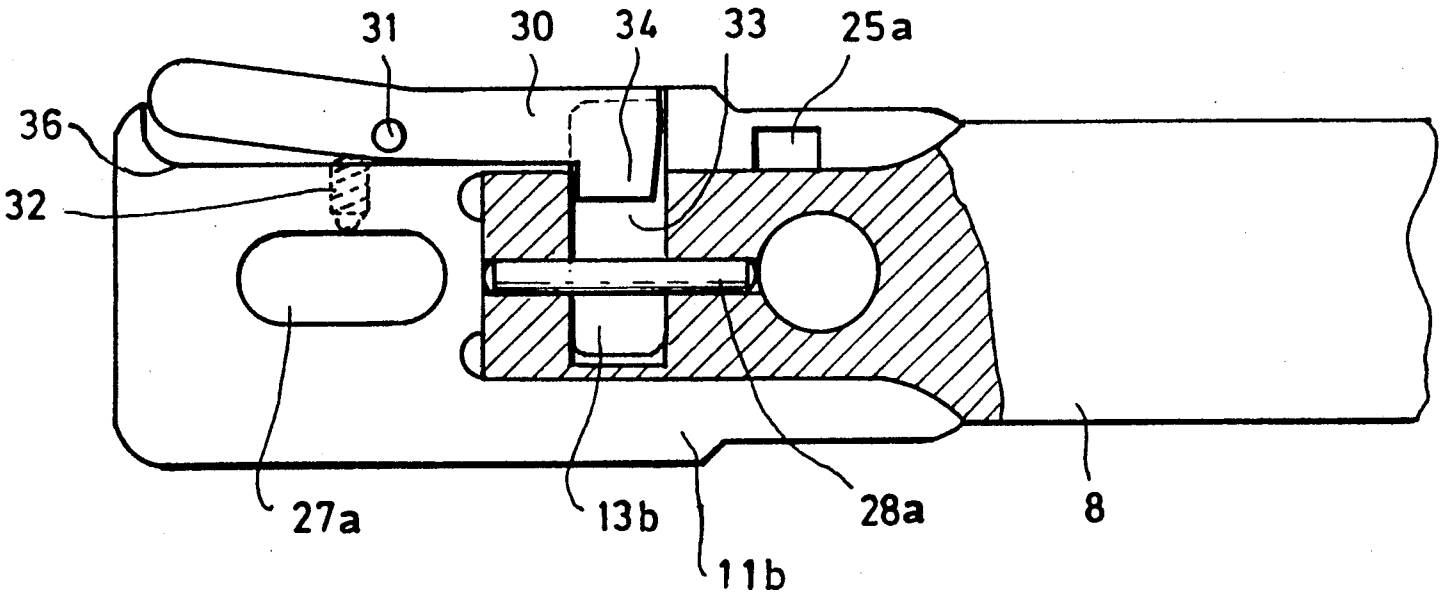

The position detent shown in FIG. 9 is arranged on the slide 11*a* and includes an elongated lever arm 30 which can be pivotally moved about the pivot pin 31. A spring element 32 presses the forward region of the arm 30 into a corresponding cutout 33 of the base body 8 below the clamping piece 13*b*. The forward region of the arm 30 includes a short lateral extension 34 which engages the cutout 33.

The lateral extension 34 is moved completely out of the cutout 33 when the lever arm is pressed in the rearward region thereof against the spring element 32 up to the stop 36. When this occurs, the slide 11*b* can be pulled toward the rear and into its release position. The elongated slot 27*a* makes this movement possible notwithstanding the rearward threaded fastener 6*b* (see FIG. 3). Because of this movement of the slide 11*b* into the release position, the clamping piece 13*b* can pivot about its pivot pin 28*a* and drop into the recess 25*a* of slide 11*b* provided therefor in order to make possible the disassembly of the sighting telescope with the adaptor as shown in FIGS. 8*a* and 8*b* and in FIGS. 1 and It is understood that the foregoing description is that of the preferred embodiments of the invention and that various changes and modifications may be made thereto without departing from the spirit and scope of the invention as defined in the appended claims.

What is claimed is:

1. An adaptor for releasably attaching a sighting telescope to a weapon, the adaptor comprising:

an elongated base body having upper and lower sides;

holding means formed on said upper side for holding the sighting telescope therein;

rigid fixing means formed on said lower surface for engaging the weapon at a first location on the weapon;

movable fixing means for releasably engaging the weapon at a second location on the weapon; and said movable fixing means including: a rigid stop formed on said base body for engaging said weapon at a first position thereon at said second location; a movable clamping piece pivotally mounted on said base body for movement between a clamp position wherein said clamping piece engages the weapon at a second position thereon at said second location to coact with said stop to clamp said base body to the weapon and a disengage position wherein said clamping piece is disengaged from said weapon.

2. The adaptor of claim 1, said holding means defining a supporting surface for the sighting telescope extending over the entire length of said base body.

3. The adaptor of claim 1, the sighting telescope having a rail formed thereon; and, said holding means including a rail guide formed on said upper side and said rail guide defining an opening having a wedge-shaped cross section for receiving said rail of the sighting telescope therein.

4. The adaptor of claim 1, said movable fixing means further including a slide mounted on said base body so as to slide between a latch position wherein said slide forces and holds said clamping piece in said clamp position and a release position when said clamping piece is released to assume said disengage position.

5. The adaptor of claim 4, said movable fixing means further comprising resilient biasing means mounted in said base body for resiliently biasing said clamping piece into said disengage position wherein said slide is in said release position.

6. The adaptor of claim 5, said movable fixing means further comprising a pivot pin mounted in said base body; and, said clamping piece being pivotally mounted on said pivot pin for movement between said clamp and disengage positions.

7. The adaptor of claim 6, said rigid fixing means and said movable fixing means conjointly defining a common axis and said pivot pin defining a pivot axis extending parallel to said common axis.

8. The adaptor of claim 4, further comprising detent means for releasably docking said slide in said latch position.

9. The adaptor of claim 1, said base body and the sighting telescope conjointly defining a closed interface therebetween extending along the length of said adaptor.

10. A removable adaptor for releasably holding a sighting telescope and for releasably attaching the sighting telescope to a weapon, the adaptor comprising:

an elongated base body having upper and lower sides;

holding means formed on said upper side for holding the sighting telescope therein;

rigid fixing means formed on said lower surface for engaging the weapon at a first location on the weapon;

movable fixing means for releasably engaging the weapon at a second location on the weapon; and said holding means defining a supporting surface for the sighting telescope extending over the entire length of said base body;

the sighting telescope having a rail formed thereon;

said holding means including a rail guide formed on said upper side and said rail guide defining an opening having a wedge-shaped cross section for receiving said rail of the sighting telescope therein; and, said movable fixing means including: a rigid stop formed on said base body for engaging said weapon at a first position thereon at said second location; a movable clamping piece pivotally mounted on said base body for movement between a clamp position wherein said clamping piece engages the weapon at a second position thereon at said second location to coact with said stop to clamp said base body to the weapon and a disengage position wherein said clamping piece is disengaged from said weapon.

11. The adaptor of claim 10, said movable fixing means further including a slide mounted on said base body so as to slide between a latch position wherein said slide forces and holds said clamping piece in said clamp position and a release position when said clamping piece is released to assume said disengage position.

12. The adaptor of claim 11, said movable fixing means further comprising a pivot pin mounted in said base body; and, said clamping piece being pivotally mounted on said pivot pin for movement between said clamp and disengage positions.

13. The adaptor of claim 11, said movable fixing means further comprising resilient biasing means mounted in said base body for resiliently biasing said clamping piece into said disengage position wherein said slide is in said release position.

14. The adaptor of claim 13, said movable fixing means further comprising a pivot pin mounted in said base body; and, said clamping piece being pivotally mounted on said pivot pin for movement between said clamp and disengage positions.

15. The adaptor of claim 14, said rigid fixing means and said movable fixing means conjointly defining a common axis and said pivot pin defining a pivot axis extending parallel to said common axis.

16. The adaptor of claim 11, further comprising detent means for releasably docking said slide in said latch position.

17. The adaptor of claim 10, said base body and the sighting telescope conjointly defining a closed interface therebetween extending along the length of said adaptor.

18. The adaptor of claim 10, said movable fixing means further comprising resilient biasing means mounted in said base body for resiliently biasing said clamping piece into said disengage position wherein said slide is in said release position.

19. The adaptor of claim 10, said movable fixing means further comprising a pivot pin mounted in said base body; and, said clamping piece being pivotally mounted on said pivot pin for movement between said clamp and disengage positions.

* * * * *